United States Patent [19]

Kubo et al.

[11] Patent Number: 4,880,965

[45] Date of Patent: Nov. 14, 1989

[54] X-RAY IMAGE INTENSIFIER HAVING VARIABLE-SIZE FLUORESCENT CRYSTALS

[75] Inventors: Hiroshi Kubo; Atsuya Yoshida, both of Ootawara, Japan

[73] Assignee: Kabushiki Kaisha Toshiba, Kawasaki, Japan

[21] Appl. No.: 167,245

[22] Filed: Mar. 11, 1988

[30] Foreign Application Priority Data

Mar. 13, 1987 [JP] Japan ..... 62-56741
Dec. 11, 1987 [JP] Japan ..... 62-311870

[51] Int. Cl.[4] ..... H01J 31/50
[52] U.S. Cl. ..... 250/213 VT; 313/525
[58] Field of Search ..... 250/213 VT, 213 R, 483.1, 250/486.1; 313/525, 527, 542, 523

[56] References Cited

U.S. PATENT DOCUMENTS 3,716,713 2/1973 Levin ..... 250/213 VT
3,829,728 8/1974 Gudden et al. ..... 313/543
3,838,273 9/1974 Cusano ..... 250/213 VT
4,437,011 3/1984 Noji et al. ..... 250/486.1

FOREIGN PATENT DOCUMENTS 2028005 10/1970 France .
2144827 2/1973 France .
2186723 1/1974 France .
0239991 10/1987 Japan ..... 250/213 VT

OTHER PUBLICATIONS

Japanese Patent Abstract, vol. 2, No. 134, Nov. 9, 1978, p. 8327 E 78; & JP-A-53 102 663 (Tokyo Shibaura Denki K.K.).

*Primary Examiner*—David C. Nelms
*Assistant Examiner*—Eric Chatmon
*Attorney, Agent, or Firm*—Cushman, Darby & Cushman

[57] ABSTRACT

An X-ray image intensifier includes a vacuum envelope having an input window for receiving X-rays, an input fluorescent screen for converting X-rays received through the input window into light, a photoelectric layer for converting the light, which was converted by the input fluorescent screen, into electrons, an anode and a converging electrode constitute an electron lens for accelerating and converging the electrons converted by the photoelectric layer, and an output fluorescent screen for converting the electrons, which were accelerated and converged by the electron lens, into a visible image. The light transmission coefficient of a peripheral portion of the input fluorescent screen is larger than that of a central portion thereof.

10 Claims, 8 Drawing Sheets

X-RAY IMAGE INTENSIFIER HAVING VARIABLE-SIZE FLUORESCENT CRYSTALS

BACKGROUND OF THE INVENTION

1. Field of the Invention

The present invention relates to an X-ray image intensifier for converting an X-ray image into a visible image.

2. Description of the Related Art

Generally, X-ray image intensifiers are widely used in medical X-ray image pickup devices or X-ray industrial TV sets for industrial nondestructive tests.

An X-ray image intensifier of this type has a vacuum envelope. The vacuum envelope has an input window for receiving X-rays. An arcuated substrate is arranged in the vacuum envelope so as to oppose the input window. An input fluorescent screen and a photoelectric layer are stacked in the above mentioned order on a surface of the substrate, which is opposite to the input window side. An anode and an output fluorescent screen are arranged on the output side of the vacuum envelope. In addition, a converging electrode is arranged along an inner side wall of the vacuum envelope.

X-rays radiated from an X-ray tube pass through an object to be imaged, the input window, and the substrate, and then converted into light by the input fluorescent screen. The light is converted into electrons by the photoelectric layer. The electrons are accelerated and focused by an electron lens constituted by the focusing electrode and the anode. The electrons are converted into a visible image by the output fluorescent screen.

The visible image is picked up by a TV camera, a cinecamera, or a spot camera, and the resultant image is used for a medical diagnosis.

Of the fluorescent screens used in the X-ray image intensifiers, a fluorescent screen has been recently used, whose film thickness is greatly increased compared with conventional fluorescent screens.

X-rays to be absorbed by an input fluorescent screen having a thickness of T can be given as:

$$1-\exp(-\psi T)$$

where $\psi$ is an X-ray absorption coefficient. FIG. 1 shows a relation between the thickness of the input fluorescent screen and the absorption rate. Referring to FIG. 1, a material of the input fluorescent screen is cesium iodide (CsI), and an energy of X-rays is 60 KeV. The absorption index of X-rays is increased with an increase in film thickness, and hence X-rays can be efficiently used. As a result, an X-ray dose and can be reduced and image quality can be improved.

When output images are observed after X-rays are uniformly radiated onto the X-ray image intensifier, it is sometimes found in an output image that a central portion is bright, whereas luminance is decreased toward a peripheral portion of the image. This is because compared with the central portion of the image, the peripheral portion of the image is expanded by a socalled electron lens in the X-ray image intensifier. With such an output luminance distribution, the dynamic range upon imaging cannot be effectively utilized for the entire screen surface. That is, a possible application range of the output image cannot be widened.

A known method of maximally flattening an output luminance range is disclosed in, e.g., Japanese Patent Disclosure (Kokai) No. 53-102663, wherein the film thickness of an input fluorescent screen is gradually increased from its central portion toward its peripheral portion, According to this method, the input fluorescent screen emits light by absorbing a larger number of X-rays at the peripheral portion than at the central portion. Therefore, in the output side, the luminance of the peripheral portion is increased, and the output luminance distribution can become close to a flat one.

However, this method cannot be applied to the X-ray image intensifier using the above-described input fluorescent screen having a large film thickness.

The reasons the method disclosed by Kokai cannot be applied will be described below. First, for the purpose of understanding of the reasons, by using a model it is determined how much light emitted from the input fluorescent screen will reach the photoelectric layer when X-rays are uniformly incident onto the input fluorescent screen. FIG. 3 shows the model. The conversion amount of X-rays converted into light at small portion dt located at depth t in the input fluorescent screen having film thickness T is proportional to the light amount at position t. Since the distance from small portion dt to the photoelectric layer is T - t, if the absorption coefficient of light in the input fluorescent screen is set to be $\beta$, an amount of light component of the light converted by small portion dt and reaching the photoelectric layer, can be given as:

$$\alpha e^{-\alpha t} \cdot e^{-\beta(T-t)} dt$$

where $\alpha$ is an X-ray absorption coefficient. Therefore, the amount of light component of the light converted by the entire input fluorescent screen can be obtained by integrating the above formula as follows:

$$\alpha \int_0^T e^{-\alpha t} \cdot e^{-\beta(T-t)} dt$$

This definite integral is calculated as follows:

$$\alpha/(\beta-\alpha)\times\exp(-\beta T)\times\{\exp[(\beta-\alpha)T]-1\}.$$

Accordingly, the value of this definite integral reaches its peak value at a given value of T. After input fluorescent screens having various film thicknesses were actually manufactured and tested, a peak value of the light amount was obtained at the photoelectric layer. FIG. 4 shows the test result. This data is obtained by measuring the luminance of an input fluorescent screen composed of CsI as a single-element film. In this case, an energy of X-rays is 60 KeV.

If the film thickness of the central portion of the input fluorescent screen is set to be the one exhibiting this peak value so as to effectively use the X-rays, the above method of correcting the output luminance distribution cannot be applied. More specifically, even if the film thickness of the peripheral portion of the input fluorescent screen is increased with respect to the central portion, luminance is decreased. As a result, the plotted output luminance distribution shows a step convex shape. In addition, if the film thickness is further increased, the resolution is degraded because of diffusion of light. That is, the film thickness corresponding to the peak value of emitted light is regarded as the maximum film thickness to be practically used. Therefore, it is necessary to solve the problem, i.e., that when an input fluorescent screen having such film thickness is realized, the output luminance distribution cannot be effectively corrected.

In addition, another problem will be described. If the film thickness is not uniform in one fluorescent screen, the X-ray absorption coefficient is changed depending on the quality of X-ray. For this reason, even if the output luminance distribution is made flat for a give X-ray quality, the output luminance distribution is not flat for other x-ray qualities.

SUMMARY OF THE INVENTION

It is an object of the present invention to provide an X-ray image intensifier which can make an output luminance distribution flat even if an input fluorescent screen of a large film thickness type is used, and can minimize changes in output luminance distribution due to changes in quality of X-rays.

According to an aspect of the present invention, there is provided an X-ray image intensifier which an X-ray image intensifier comprising a vacuum envelope having an input window for receiving X-rays, an input fluorescent screen for converting X-rays received through said input window into light, a light transmission coefficient of a peripheral portion of said input fluorescent screen which is larger than that of a central portion thereof, a photoelectric layer for converting the light into electrons, electrode means constituting an electron lens for accelerating and converging the electrons, and an output fluorescent screen for converting the electrons, which were accelerated and converged by said electron lens into a visible image.

According to the present invention, a light transmission coefficient is defined as the light transmissivity per the unit thickness of a sample. In particular, X-rays strike the input fluorescent screen and are converted to light, at which point the light is transmitted through the fluorescent screen: the light transmission coefficient indicates the percent of the light, converted from X-rays, which passes through the fluorescent screen and which is not absorbed, with respect to the total light generated by the fluorescent screen. Therefore, the greater the transmission coefficient, the greater the amount of light rays that is transmitted through the fluorescent screen, and the smaller the amount of corresponding light rays that are absorbed by the fluorescent screen.

The input fluorescent screen has a varying transmission coefficient whereby the value is greater at the peripheral portion of input fluorescent screen than at the central portion, thus providing a flat output luminance distribution with respect to the central and peripheral portions of the input fluorescent screen.

DETAILED DESCRIPTION OF THE PREFERRED EMBODIMENT

Figure 1:
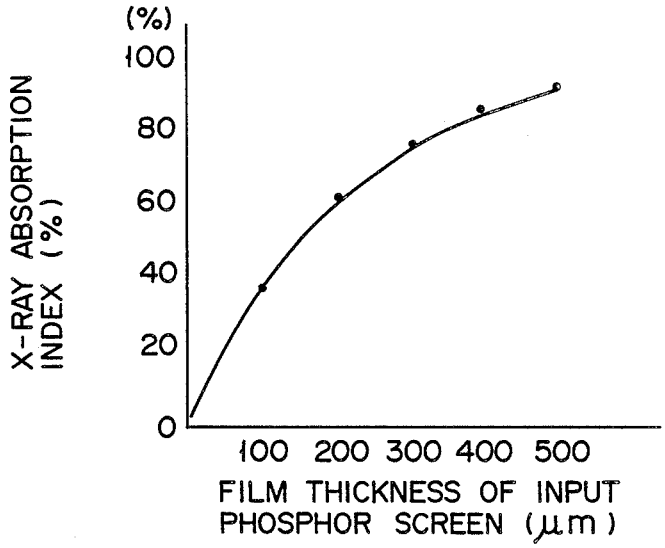
FIG. 1 is a graph showing a relation between the film thickness of an input fluorescent screen and the X-ray absorption coefficient.
Figure 2:
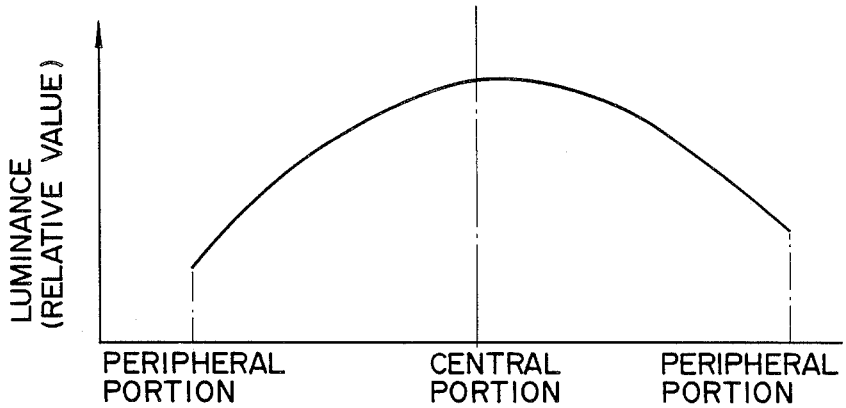
FIG. 2 is a graph of an output luminance distribution.
Figure 3:
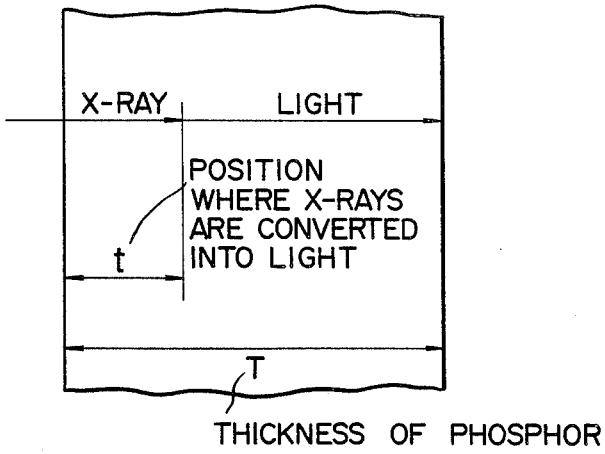
FIG. 3 is a view illustrating a state wherein light emitted in the input fluorescent screen is attenuated.
Figure 4:
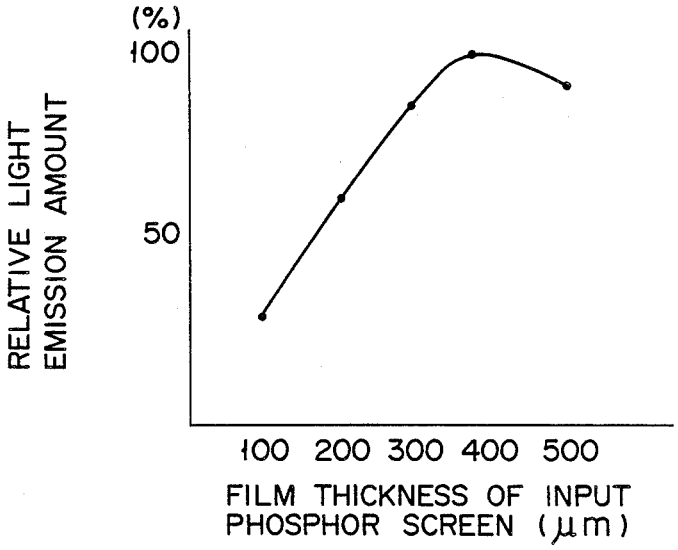
FIG. 4 is a graph showing a relation between the film thickness of the input fluorescent screen and the relative amount of emitted light.
Figure 5:
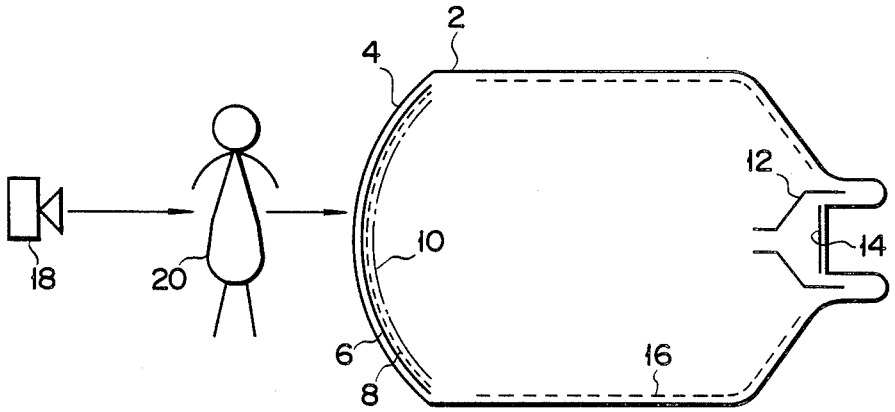
FIG. 5 is a view of an X-ray image intensifier according to the present invention.

Referring to FIG. 5, reference numeral 2 denotes a vacuum envelope of an X-ray image intensifier. Vacuum envelope 2 has input window 4 for receiving X-rays. Arcuated board (substrate) 6 is arranged in vacuum envelope 2 so as to oppose input window 4. Input phosphor screen 8 and photoelectric layer 10 are stacked in the above mentioned order on a surface of substrate 6, which is opposite to the input window 4 side. Input fluorescent screen 8 converts X-rays received through input window 4 into light. Photoelectric layer 10 converts the lightrays converted by input fluorescent screen 8 into electrons. In addition, anode 12 and output fluorescent screen 14 are arranged on an output side of vacuum envelope 2. Converging electrode 16 is arranged along an inner side wall of vacuum envelope 2. Anode 12 and converging electrode 16 form an electron lens for accelerating and converging the electrons converted by photoelectric layer 10. Output fluorescent screen 14 converts the electrons, which have been accelerated and converged by the electron lens constituted by anode 12 and converging electrode 16, into a visible image.

X-rays radiated from X-ray tube 18 pass through object 20 to be imaged, input window 4, and board 6, and is then converted into light by input fluorescent screen 8. The light is converted into electrons by photoelectric layer 10. The electrons are accelerated and focused by the electron lens constituted by anode 12 and converging electrode 16. The electrodes are converted into a visible image by output fluorescent screen 14.

The visible image is picked up by a TV camera, a cinecamera, a spot camera, or the like, thereby performing a medical diagnosis or the like.

Figure 6:
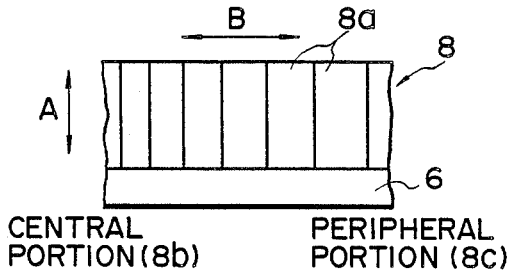
FIG. 6 is a sectional view illustrating the input fluorescent screen used in the X-ray image intensifier in FIG. 5.
Figure 7:
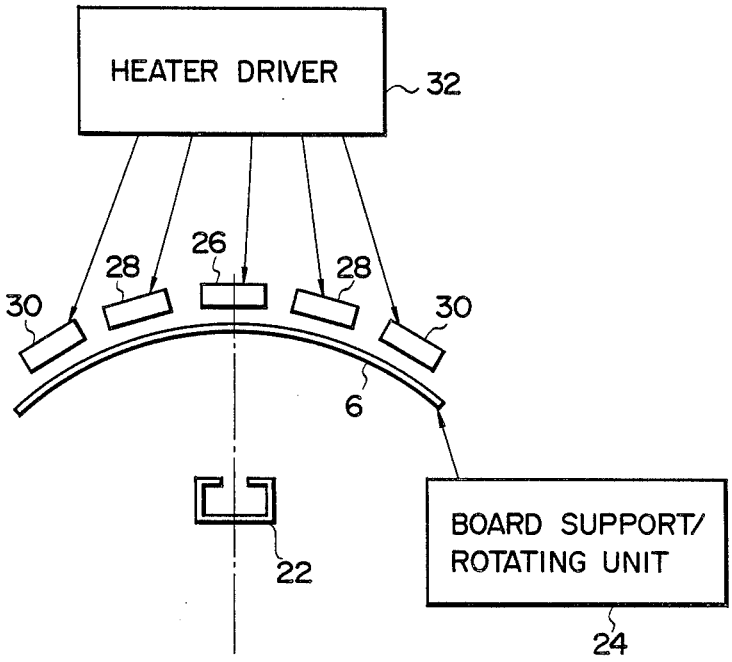
FIG. 7 is a schematic view of an apparatus for forming a film of the input fluorescent screen in FIG. 6.
Figure 8:
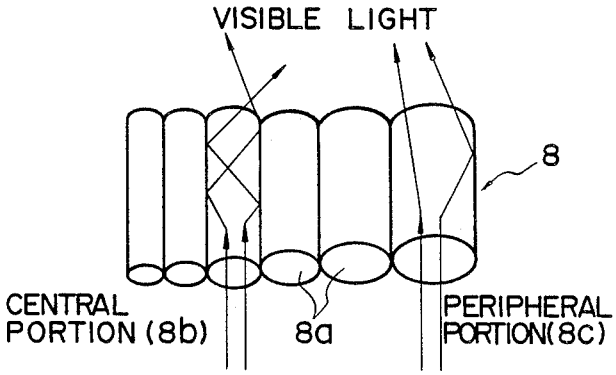
FIG. 8 is a view for explaining the transmission coefficient of the input fluorescent screen in FIG. 6.

As shown in FIGS. 6 and 7, input fluorescent screen 8 is constituted by elongated columnar crystals arranged along a direction indicated by reference direction A perpendicular to input fluorescent screen 8 which is indicated by reference direction B. Each columnar crystal 8*a* is composed of cesium iodide (CsI), which is activated by using an activator such as sodium. As shown in FIG. 8, the diameters of pillar-like crystals 8*a* gradually increase as they extend from central portion 8*b* toward peripheral portion 8*c* of input fluorescent screen 8. The thickness of input fluorescent screen 8 is made to be substantially uniform throughout central and peripheral portions 8*b*, 8*c*.

FIG. 7 schematically shows a film forming apparatus for forming input fluorescent screen 8 on board 6. Referring to FIG. 7, reference numeral 22 denotes a vapor source. Board 6 is supported by board support/rotating unit 24 above vapor source 22. Circular central heater 26, annular intermediate heaters 28, and annular peripheral heaters 30 are arranged above board 6. Central heat 26 heats a central portion of board 6. Intermediate heaters 28 heat an intermediate portion of substrate 6. Peripheral heaters 30 heat a peripheral portion of substrate 6. Heaters 26, 28, and 30 are driven by heater driver 32. In addition, temperature sensors (not shown) for monitoring the temperatures of substrate 6 are arranged near heaters 26, 28, and 30.

Heaters 26, 28, and 30 are driven by heater driver 32 during deposition of CsI such that the temperatures of the central portion and peripheral portions are respectively kept at 150° to 200° C. and 200° to 250° C., and the temperature of the intermediate portion of substrate 6 is kept within a temperature which falls between the temperature of the central and peripheral portions. Heaters 26, 28, and 30 are driven by heater driver 32. The temperature gradient from the central portion to the peripheral portion may be linearly changed, or may be moderately changed near the central portion and more abruptly changed near the peripheral portion.

In such an apparatus, when crystal seeds are attached to substrate 6 while the temperatures of the central and peripheral portions thereof are respectively kept at 150° C. and 250° C., crystals 8*a* are grown such that the diameter of a central crystal is about 2 μm and the diameter of a peripheral crystal is about 6 μm. Each pillar-like crystal 8*a* is grown from a corresponding seed in the form of a pillar in a direction perpendicular to substrate 6. Thus, columnar crystals 8*a*, whose diameters increase as they extend toward the peripheral portions, can be obtained by setting the temperatures of substrate 6 to gradually increase as they extend from central portion 8*b* toward peripheral portion 8*c* of input fluorescent screen 8.

According to the present invention, a light transmission coefficient is defined as the light transmissivity per the unit thickness of a sample. In particular, X-rays strike the input fluorescent screen and are converted to light, at which point the light is transmitted through the fluorescent screen: the light transmission coefficient indicates the percent of the light, converted from X-rays, which passes though the fluorescent screen and which is not absorbed, with respect to the total light rays generated by the fluorescent screen. Therefore, the greater the transmission coefficient, the greater the amount of light that is transmitted through the fluorescent screen, and the smaller the amount of corresponding light that is absorbed by the fluorescent screen.

As shown in FIG. 8, light converted from the X-rays in columnar crystal 8*a* has been reflected fewer times on an inner wall of columnar crystal 8*a* with a resulting increase in the diameter of crystal 8*a*, and the loss of light at an interface between columnar crystals 8*a* is thereby reduced. Since the transmission coefficient of central portion 8*b* is larger than that of peripheral portion 8*c* of input fluorescent screen 8, the amount of light radiated from peripheral portion 8*c* of input fluorescent screen 8 toward fluorescent screen 10 is larger than that from central portion 8*b*.

As described above, assuming that the X-ray absorption coefficient and light absorption coefficient of input fluorescent screen 8 having thickness T are respectively set to be $\alpha$ and $\beta$, the amount (relative value) of light reaching photoelectric layer 10 can be given as:

$$\alpha/(\beta-\alpha)\times\exp(-\beta T)\times\{\exp[(\beta-\alpha)T]-1\}.$$

When $\alpha=\beta$, $$\alpha T\cdot\exp(-\alpha T).$$

Figure 9:
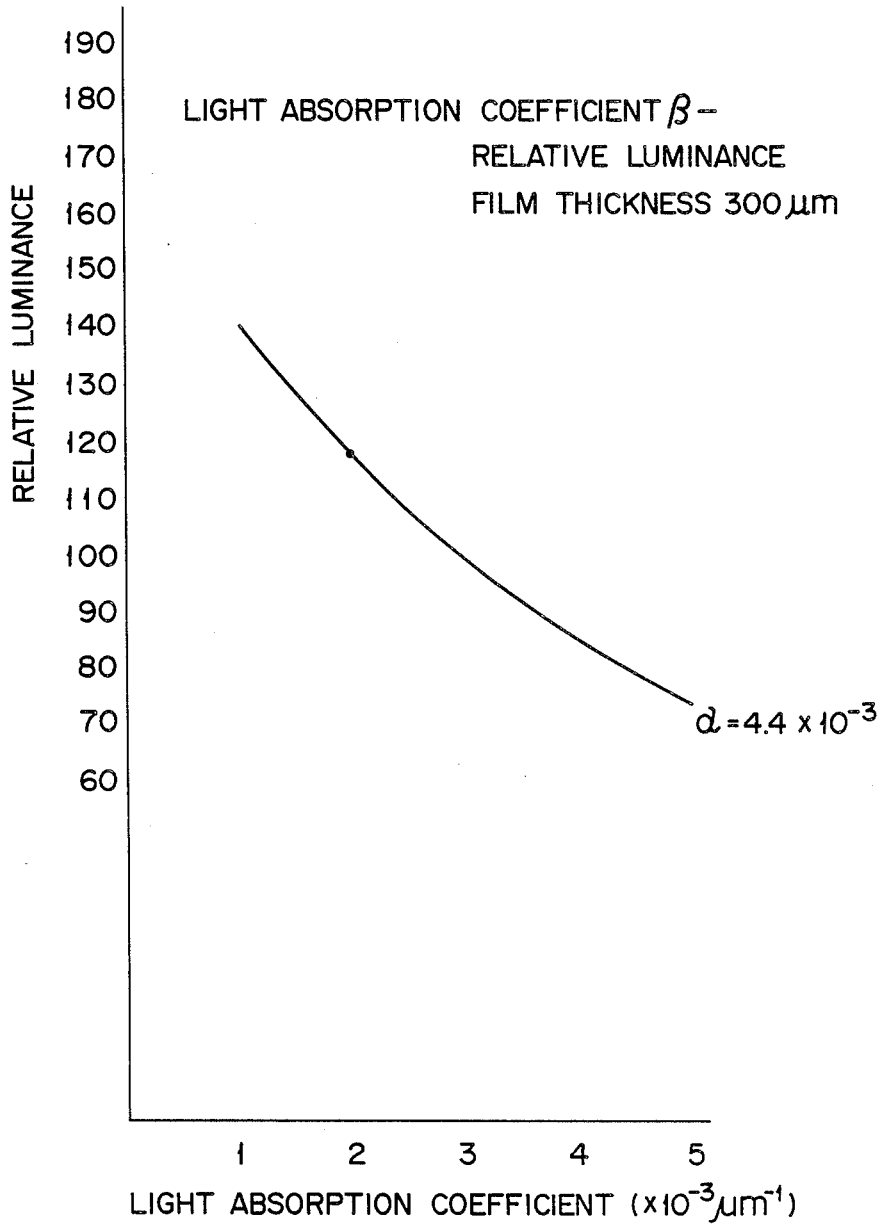
FIG. 9 is a graph showing a relation between the light absorption coefficient of the input fluorescent screen in FIG. 6 and the relative luminance.

When X-ray absorption coefficient $\alpha$ is a measurement value of $4.4\times10^3$ $\mu m^{-1}$ with respect to a monochromatic X-ray of 60 KeV, film thickness T of input fluorescent screen 8 is 300 $\mu m^{-1}$, and light absorption coefficient $\beta$ is changed from $1\times103$ $\mu m^{-1}$ to $5\times10^3$ $\mu m^{-1}$, then the relative luminance can be plotted as shown in FIG. 9. In FIG. 9, if light absorption coefficient $\beta$ is changed from $3\times103$ $\mu m^{-1}$ to $2\times10^3$ $\mu m^{-1}$, the luminance is increased by about 18%.

Figure 10:
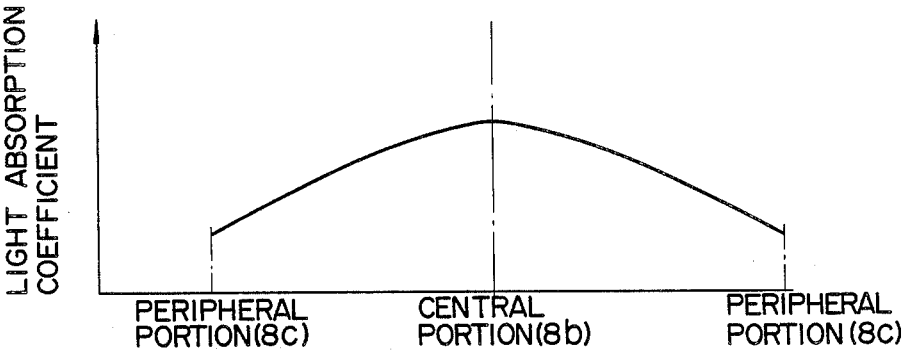
FIG. 10 is a graph showing the light absorption coefficient distribution of the input fluorescent screen in FIG. 6.
Figure 11:
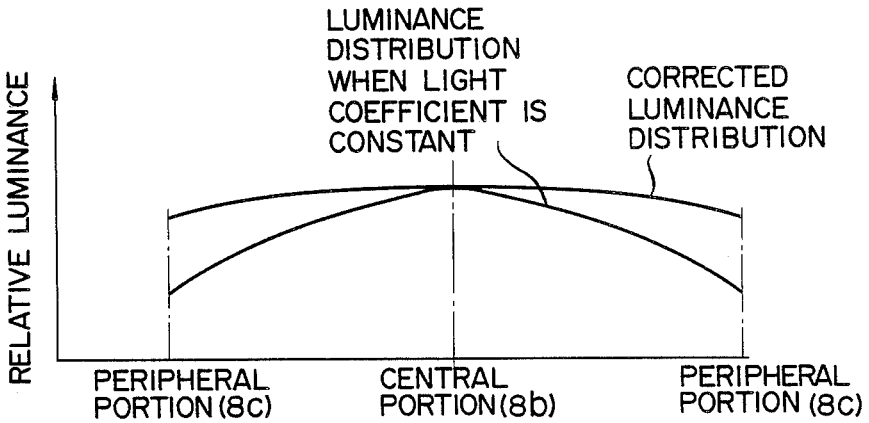
FIG. 11 is a graph showing the relative luminance distribution of the input fluorescent screen in FIG. 6.

When the light absorption coefficient of input fluorescent screen 8 gradually decreases from central portion 8*b* toward peripheral portion 8*c*, i.e., the transmission coefficient of input fluorescent screen 8 gradually increases as it extends from central portion 8*b* toward peripheral portion 8*c*, as shown in FIG. 10, then the relative luminance can be made substantially uniform, as shown in FIG. 11.

Since input fluorescent screen 8 is composed of elongated columnar crystals 8*a* arranged in the direction perpendicular to input fluorescent screen 8, the light, excluding light directed in the direction perpendicular to input fluorescent screen 8, is totally reflected by the inner surfaces of columnar crystals 8a or passes through gaps located between columnar crystals 8*a*, and is attenuated. That is, the light absorption coefficient of input fluorescent screen 8 in the direction along input fluorescent screen 8 (the direction indicated by reference symbol B in FIG. 6) is smaller than that of the light absorption coefficient in the direction perpendicular thereto (the direction indicated by reference symbol A in FIG. 6). Since diffusion of the light, excluding the light perpendicular to input fluorescent screen 8, can be reduced, the resolution can be improved.

Figure 12:
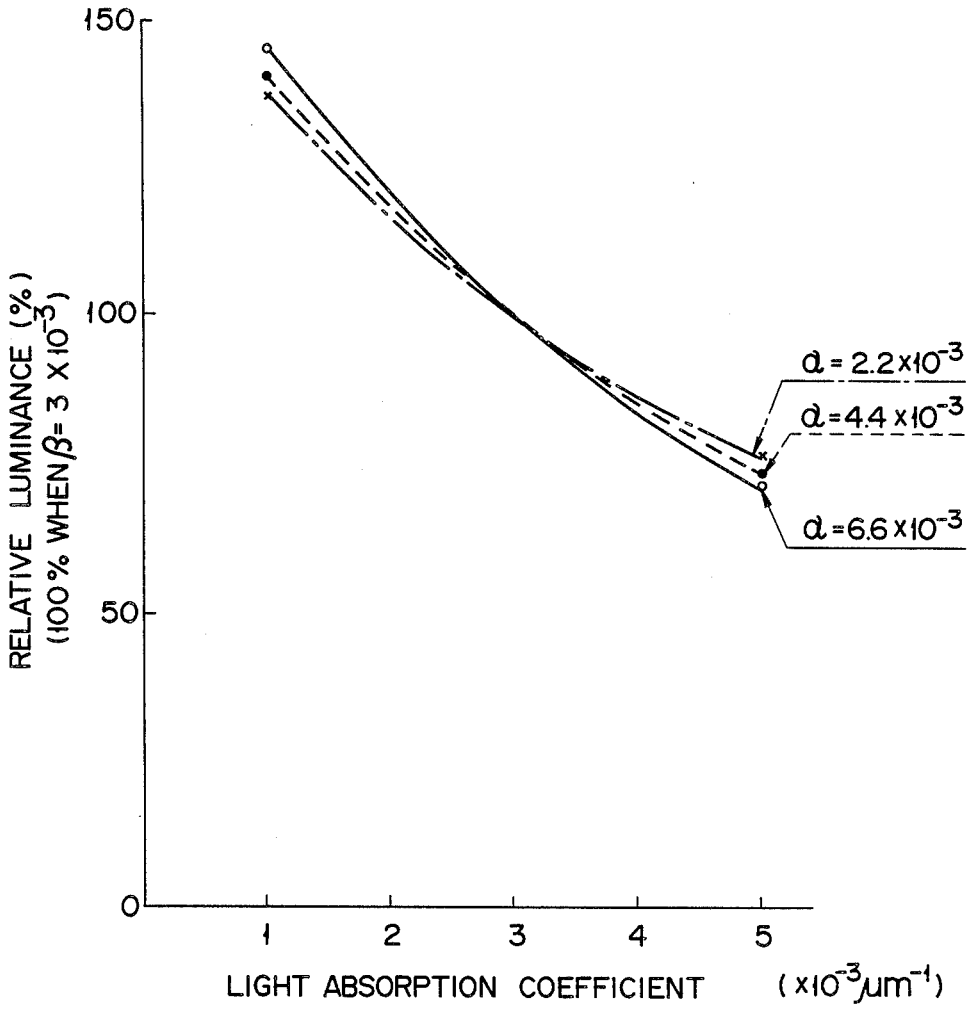
FIG. 12 is a graph showing a relation between the light absorption coefficient of the input fluorescent screen in FIG. 6 and the relative luminance.

X-ray absorption coefficeent $\alpha$ of input fluorescent screen 8 changes as the quality of the X-ray is changed. However, as shown in FIG. 12, it was discovered from the calculations of the above formula that changes in the X-ray absorption coefficient do not greatly influence the relation between light absorption coefficient $\beta$ and the relative luminance. Therefore, the output luminance of input fluorescent screen 8 is not greatly influenced by the quality of the X-ray.

In addition, since the film thickness of input fluorescent screen 8 is substantially constant, the deposition can be easily controlled. Furthermore, since the light absorption coefficient of input fluorescent screen 8 can be altered by changing the temperature of the substrate during deposition, input fluorescent screen 8 having the above arrangement can be easily manufactured by means of deposition.

According to the above arrangement, even when input fluorescent screen 8 having a large film thickness type is used, the resolution and photoelectric sensitivity of the peripheral portion of input fluorescent screen 8 can be improved. Therefore, as shown in FIG. 11, the output luminance distribution can be corrected so as to be flat. At the same time, changes in the output luminance distribution, which are caused by changes in the quality of X-rays, can be minimized.

Figure 13:
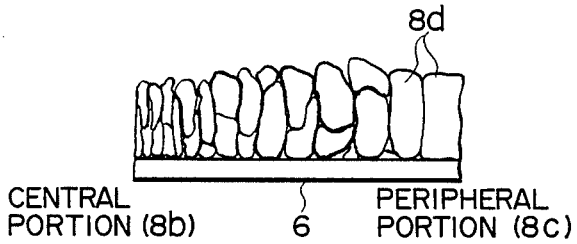
FIG. 13 is a schematic sectional view showing a modification of the input fluorescent screen.

Although input fluorescent screen 8 of the above embodiment is composed of columnar crystals 8*a*, it may also be composed of normal crystals 8*d*, as shown in FIG. 13.

Figure 14:
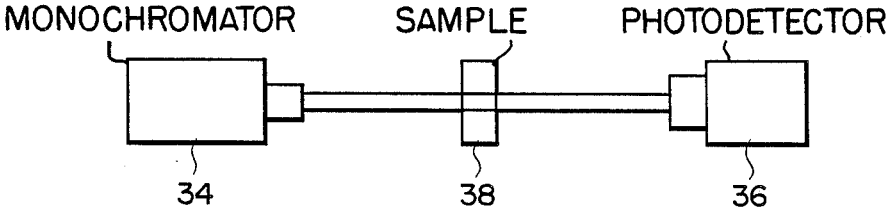
FIG. 14 is a view of a measuring device of transmittance.

FIG. 14 shows a measuring device for measuring the light transmittance. The device comprises monochromator 34 for emitting monochromatic light and photodetector 36 for detecting the monochromatic light. The light transmittance is obtained from the ratio representing the amount of light which is transmitted when sample 38 is located on the path of the monochromatic light, compared with the amount of light transmitted when it is not on the path. The relation between the light transmission coefficient and the light transmittance an be given as:

$$\text{light transmittance} = \exp(-AT)$$

where A denotes the light transmission coefficient, and T denotes the thickness of a sample.

What is claimed is:

1. An X-ray image intensifier comprising:

a vacuum envelope having an input window for receiving X-rays;

an input fluorescent screen having a peripheral portion and a central portion, for converting X-rays received through said input window into light, said peripheral portion of said input fluorescent screen having a larger light transmission coefficient than said central portion;

a photoelectric layer for converting the light into electrons;

electrode means constituting an electron lens for accelerating and converging the electrons; and an output fluorescent screen for converting the electrons, which were accelerated and converged by said electron lens, into a visible image.

2. The X-ray image intensifier according to claim 1, wherein a light transmission coefficient of said input fluorescent screen with respect to light in a direction along said input fluorescent screen is smaller than that of a light transmission coefficient with respect to light in a direction perpendicular to said input fluorescent screen.

3. The X-ray image intensifier according to claim 1, wherein said input fluorescent screen essentially consists of fluorescent crystals, and the sizes thereof gradually increase as said fluorescent crystals extend from the central portion of said input fluorescent screen toward the peripheral portion thereof.

4. The X-ray image intensifier according to claim 3, wherein said crystals are formed into elongated columnar shapes and arranged along a direction perpendicular to said input fluorescent screen, and the diameters of said crystals gradually increase as they extend from the central portion of said input fluorescent screen toward the peripheral portion thereof.

5. The X-ray image intensifier according to claim 1, wherein said input fluorescent screen essentially consists of sodium-activated cesium iodide.

6. The X-ray image intensifier according to claim 5, wherein said input fluorescent screen essentially consists of activated cesium iodide.

7. A fluorescent screen, used in an X-ray image intensifier, for converting incident X-rays cast upon said X-ray image intensifier into light and outputting the light, comprising:

a first portion composed of crystals having a predetermined size; and a second portion composed of crystals larger than said crystals which constitute said first portion, said second portion being located on a peripheral portion of said fluorescent screen with respect to said first portion.

8. An X-ray image intensifier comprising:

a vacuum envelope having an input window for receiving X-rays;

an input fluorescent screen having a central and peripheral portion, for converting X-rays received through said input window into light, said peripheral portion of said input fluorescent screen having a larger transmission coefficient than said central portion, said input fluorescent screen consisting of fluorescent crystals whose diameters gradually increase as said crystals are disposed further from the central portion of said input fluorescent screen toward the peripheral portion thereof;

a photoelectric layer for converting the light into electrons;

electrode means comprising an electron lens for accelerating and converging the electrons; and an output fluorescent screen for converting the electrons, which were accelerated and converged by said electrons lens, into a visible image.

9. An X-ray image intensifier comprising:

a vacuum envelope having an input window for receiving X-rays;

an input fluorescent screen having a peripheral portion and a central portion, for converting X-rays received through said input window into light, said input fluorescent screen having a substantially uniform thickness, said peripheral portion of said input fluorescent screen having a larger light transmission coefficient than said central portion, said input fluorescent screen essentially consisting of fluorescent crystals having sizes that increase as said fluorescent crystals are disposed further from said central portion toward said peripheral portion;

a photoelectric layer for converting the light into electrons;

electrode means for accelerating and converging the electrons; and an output fluorescent screen for converting the electrons accelerated and converged by said electrode means into a visible image.

10. An X-ray image intensifier comprising:

a vacuum envelope having an input window for receiving X-rays;

an input fluorescent screen having a peripheral portion and a central portion, for converting X-rays received through said input window into light, said peripheral portion of said input fluorescent screen having a larger light transmission coefficient than said central portion, said input fluorescent screen essentially consisting of fluorescent crystals having sizes that increase as said fluorescent crystals are disposed further from said central portion toward said peripheral portion;

a photoelectric layer for converting the light-rays into electrons;

electrode means for accelerating and converging the electrons;

an output fluorescent screen for converting the electrons accelerated and converged by said electrode means into a visible image; and wherein said crystals are formed into elongated columnar shapes and arranged along a direction perpendicular to said input fluorescent screen, said crystals having diameters that gradually increase as said crystals are disposed further from said central portion toward said peripheral portion, said crystals having substantially uniform lengths throughout said central and peripheral portions.

* * * * *